US007932795B2

(12) United States Patent
Kozai et al.

(10) Patent No.: US 7,932,795 B2
(45) Date of Patent: Apr. 26, 2011

(54) SILENT ELECTROMAGNETIC RELAY

(75) Inventors: Yuji Kozai, Yamaga (JP); Takeshi Nishiyama, Kumamoto-ken (JP)

(73) Assignee: OMRON Corporation, Kyoto-shi, Kyoto (JP)

( * ) Notice: Subject to any disclaimer, the term of this patent is extended or adjusted under 35 U.S.C. 154(b) by 390 days.

(21) Appl. No.: 11/894,306

(22) Filed: Aug. 21, 2007

(65) Prior Publication Data

US 2008/0048808 A1 Feb. 28, 2008

(30) Foreign Application Priority Data

Aug. 28, 2006 (JP) ..... 2006-230739

(51) Int. Cl.
*H01H 51/22* (2006.01)

(52) U.S. Cl. ..... 335/78; 335/128

(58) Field of Classification Search ..... 335/78–86, 335/128, 129

See application file for complete search history.

(56) References Cited

U.S. PATENT DOCUMENTS

| | | | | |
|---|---|---|---|---|
| 4,460,881 A | | 7/1984 | Meister et al. | |
| 4,739,293 A | * | 4/1988 | Hurley et al. | 335/132 |
| 5,515,019 A | * | 5/1996 | Schedele | 335/78 |
| 5,694,099 A | * | 12/1997 | Connell et al. | 335/78 |
| 5,949,313 A | * | 9/1999 | Aoki et al. | 335/78 |
| 6,794,966 B2 | * | 9/2004 | Thrush et al. | 335/80 |
| 6,798,322 B2 | * | 9/2004 | Copper et al. | 335/128 |

FOREIGN PATENT DOCUMENTS

| | | |
|---|---|---|
| EP | 1 026 717 A1 | 8/2000 |
| EP | 1 420 428 A1 | 5/2004 |
| JP | 6-52774 | 2/1994 |
| JP | 8-069737 | 3/1996 |

OTHER PUBLICATIONS

European Search Report for European Application No. 07 11 1638, mailed on Feb. 29, 2008 (2 pages).

English abstract of JP8069737 published Mar. 12, 1996, data supplied from the esp@cenet database, 1 page.

* cited by examiner

*Primary Examiner* — Elvin G Enad
*Assistant Examiner* — Bernard Rojas
(74) *Attorney, Agent, or Firm* — Osha Liang LLP

(57) ABSTRACT

A silent electromagnetic relay in which a predetermined degree of silencing effect can be maintained regardless of a change to the specification, a higher silencing effect can be obtained at the time of return, the parts control is easy, and the cost of manufacturing is low. A first silent spring is mounted in a position of an inward face of a moving iron to be attracted to an iron core of an electromagnet portion, and an L-shaped moving iron turning based on excitation and demagnetization of the electromagnet portion is housed in a housing that is a resin molded product. Furthermore, a second silent spring for coming in contact with an inner face of the housing is mounted to an outward face of the moving iron and on an opposite side to the first silent spring.

3 Claims, 9 Drawing Sheets

SILENT ELECTROMAGNETIC RELAY

BACKGROUND OF THE INVENTION

1. Field of the Invention

The present invention relates to a silent electromagnetic relay and particularly to a silent electromagnetic relay which generates no offensive collision noise at times of operation and return.

2. Description of the Related Art

As a conventional silent electromagnetic relay, there is a silencing device of a small relay as shown in FIG. 1 of Japanese Patent Application Laid-open No. 8-69737, for example, in which an elastic member 31 bent substantially in a V shape is mounted in a position of an L-shaped armature 27 and facing a magnetic pole portion of a core 29 and an elastic member 32 is mounted in a position of the armature 27 and facing an outward face of the yoke 23, the armature 27 supported for turning on an upper end portion of a yoke 23. The elastic member 31 comes in contact with the core 29 at the time of operation and the elastic member 32 comes in contact with the yoke 23 at the time of return and, as a result, the elastic members 31, 32 absorb the collision noise.

However, in the above-described small relay, it is necessary to change a bending angle of the armature according to a change to the specification made by a customer, e.g., a change to an operating voltage, a return voltage, or the like in the above-described small relay, though the basic structure is the same. In this case, in general, in order to eliminate the necessity to start over designing related to operations of the core and the armature, the bending angle of the armature is changed while keeping a distance between the magnetic pole portion of the core and a contact face of the armature constant and therefore a distance between the outward face of the yoke and the contact face of the armature changes. Consequently, in order to maintain a predetermined degree of silencing effect at the time of return, it is necessary to change a shape of the elastic member that comes in contact with the outward face of the yoke. As a result, a silent spring adapted to a customer specification need be prepared, which complicates parts control and increases cost of manufacturing.

Moreover, in the above-described small relay, a metal armature comes in contact with a metal core or a metal yoke both at the time of operation and at the time of return and therefore it is not easy to obtain high silencing effect.

In view of the above problems, it is an object of the present invention to provide a silent electromagnetic relay in which a predetermined degree of silencing effect can be maintained irrespective of a change to the specification, a higher silencing effect can be obtained at the time of return, the parts control is easy, and the cost of manufacturing is low.

SUMMARY OF THE INVENTION

To achieve the above object, according to the present invention, there is provided a silent electromagnetic relay including an L-shaped moving iron for turning based on excitation and demagnetization of an electromagnet portion housed in a housing that is a resin molded product, a first silent spring being mounted in a position of an inward face of a moving iron to be attracted to an iron core of the electromagnet portion and a second silent spring for coming in contact with an inner face of the housing being mounted to an outward face of the moving iron and on an opposite side to the first silent spring.

According to the invention, the first and second silent springs are mounted in such positions that a distance between the moving iron and a magnetic pole portion of the iron core need not be changed even if the specification is changed. Therefore, shapes of the first and second silent springs need not be changed. As a result, a predetermined degree of silencing effect can be maintained and parts control becomes easy to thereby reduce cost of manufacturing.

Moreover, because the second silent spring mounted to the moving iron comes in contact with an inner face of the housing that is the resin molded product in return, it is possible to obtain an electromagnetic relay having a higher silencing effect than a conventional one.

As an embodiment of the invention, the first silent spring and the second silent spring may have the same shapes.

According to the embodiment, because the silent springs having the same shapes can be used, the silent springs can be produced by using one kind of stamping die. Therefore, the parts control becomes easy to thereby further reduce the cost of manufacturing.

As other embodiments of the invention, the second silent spring may come in contact with a bottom face of the housing or the second silent spring may come in contact with a ceiling face of the housing.

According to the embodiments, because the second silent spring made of metal comes in contact with the housing that is the resin molded product, it is possible to obtain the electromagnetic relay having the higher silencing effect than in a conventional art in which the spring comes in contact with a metal yoke.

DETAILED DESCRIPTION OF THE PREFERRED EMBODIMENTS

Figure 1:
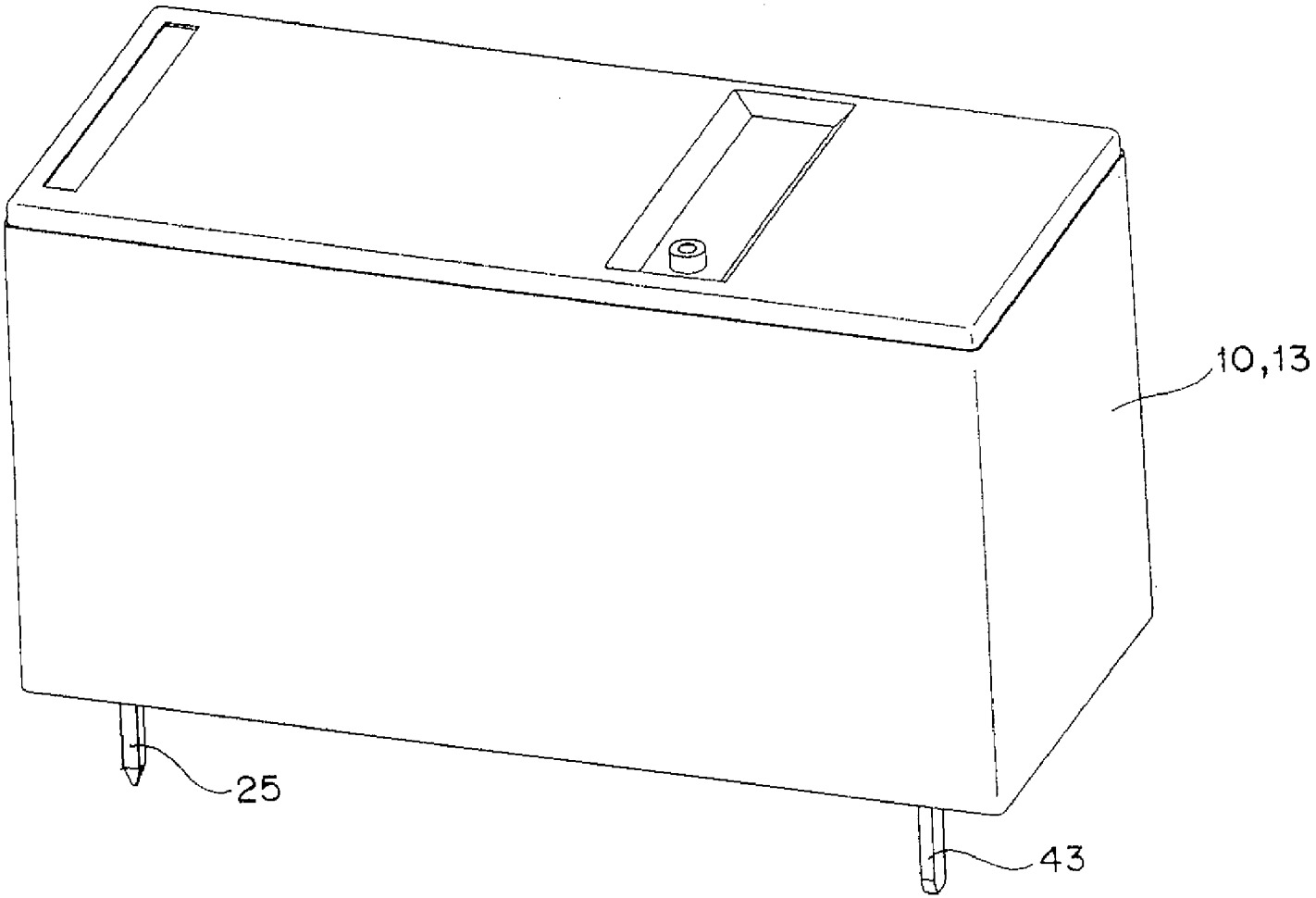
FIG. 1 shows a general perspective view of a silent electromagnetic relay according to a first embodiment of the present invention.
Figure 2:
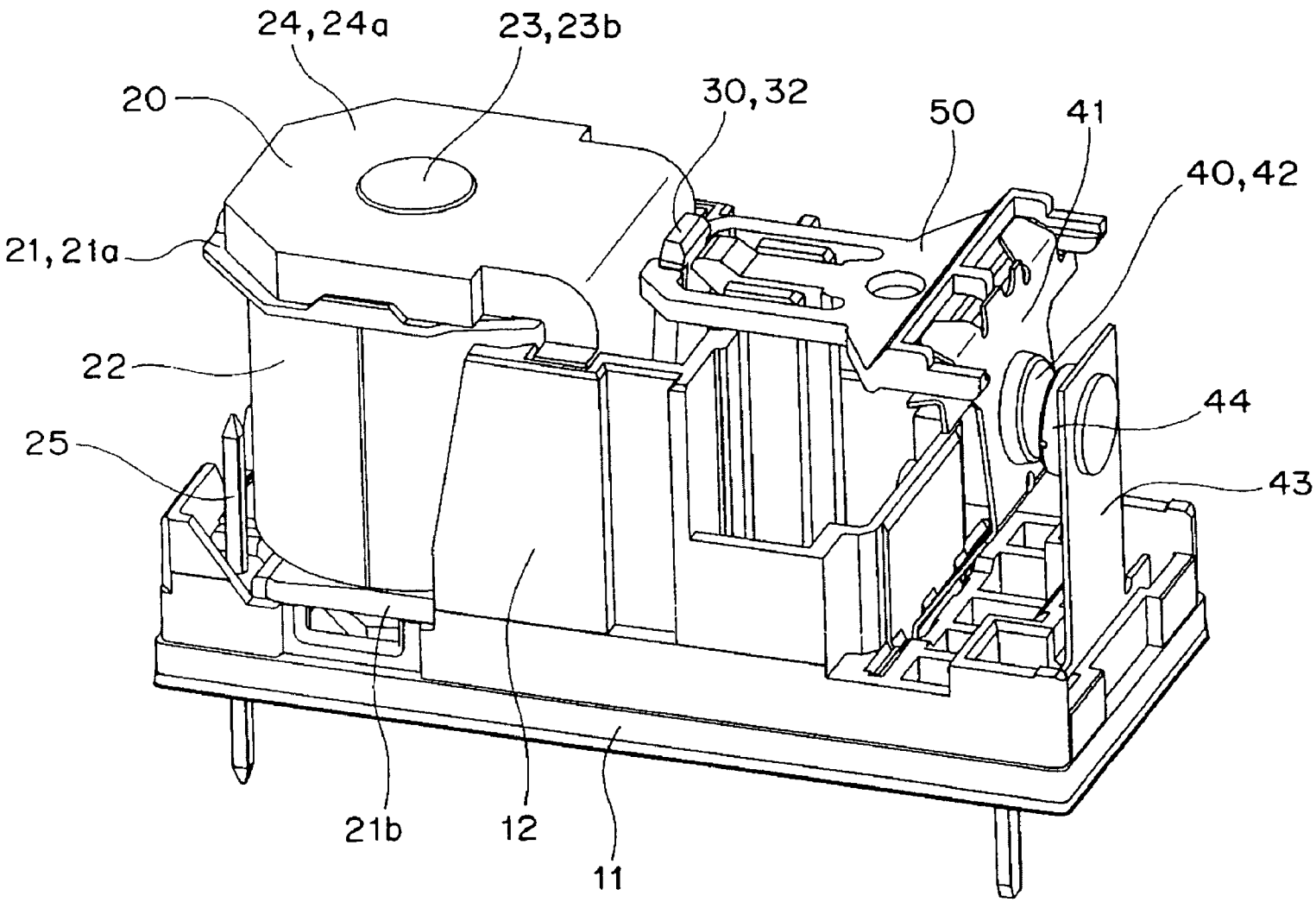
FIG. 2 shows a perspective view of the silent electromagnetic relay which is shown in FIG. 1 and from which a cover is detached.
Figure 3:
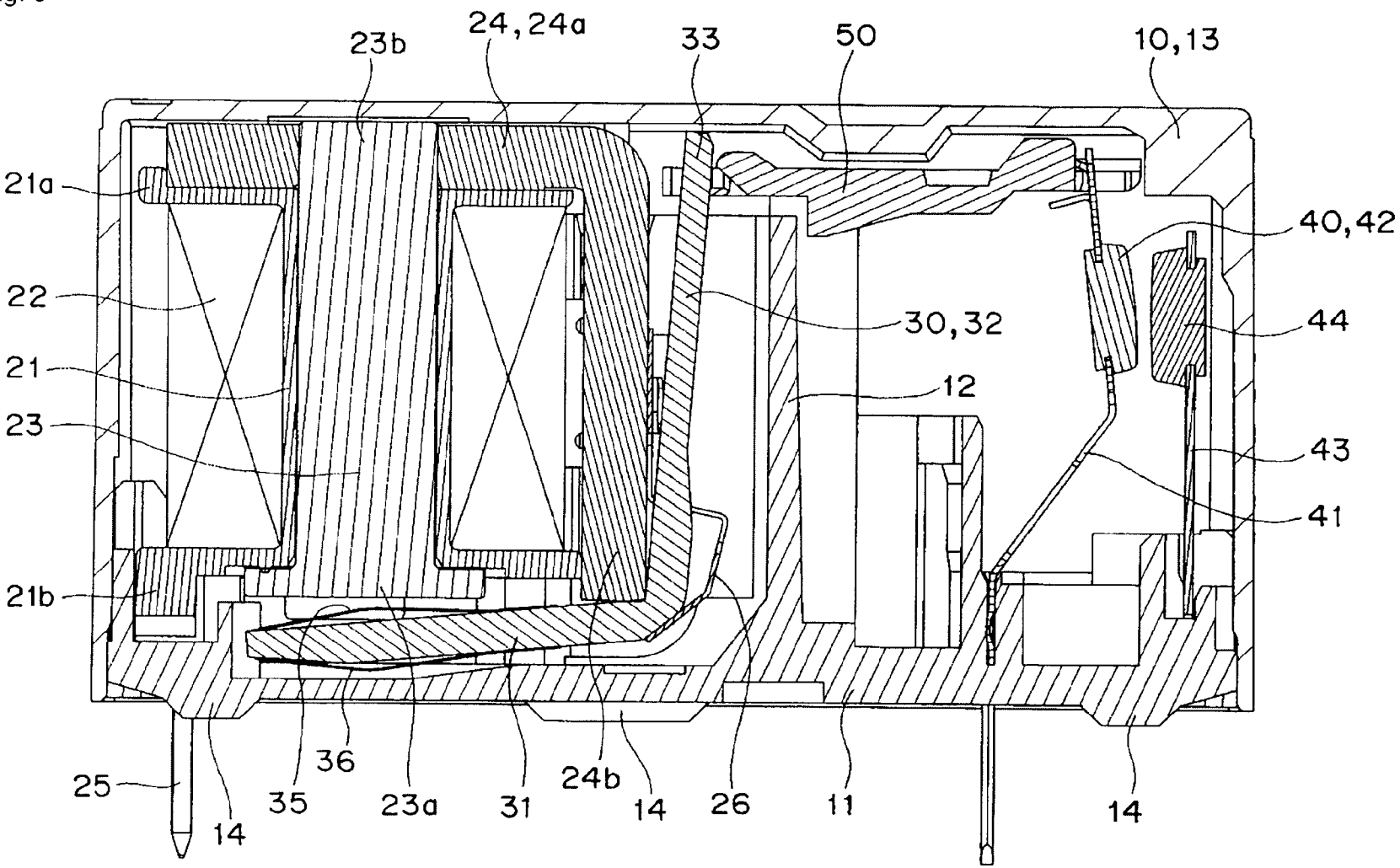
FIG. 3 shows a sectional view of a silent electromagnetic relay shown in FIG. 1.
Figure 4B:
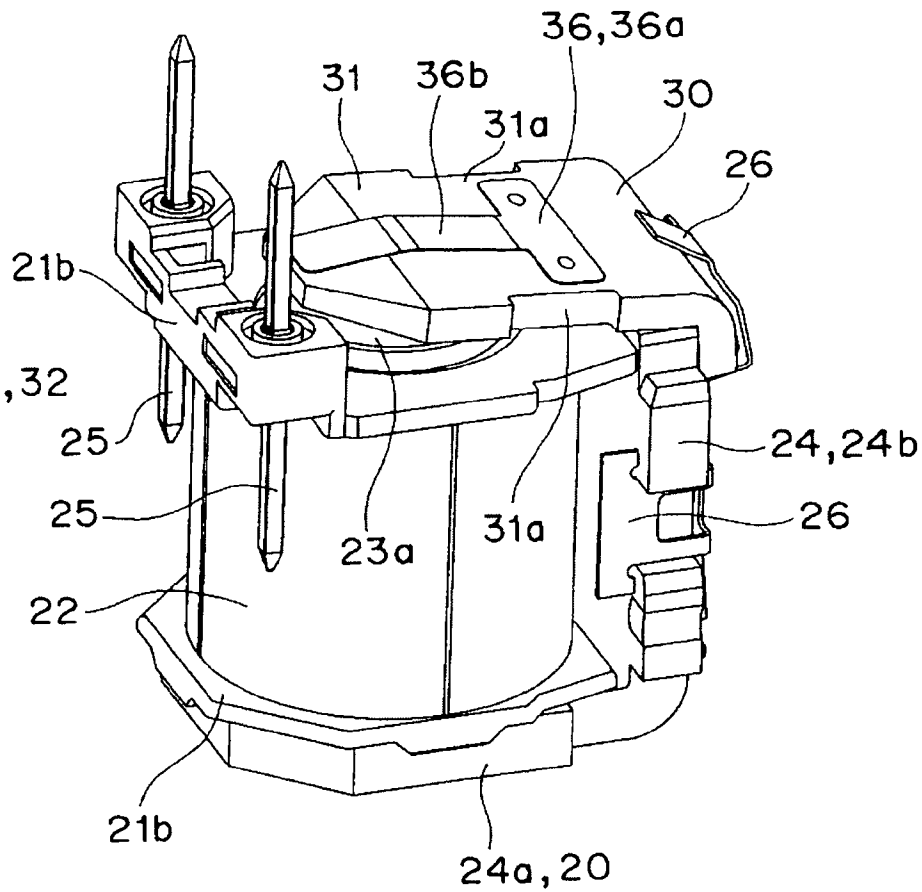
FIGS. 4A and 4B show perspective views of an electromagnet block of the silent electromagnetic relay shown in FIG. 2 from different angles.
Figure 4A:
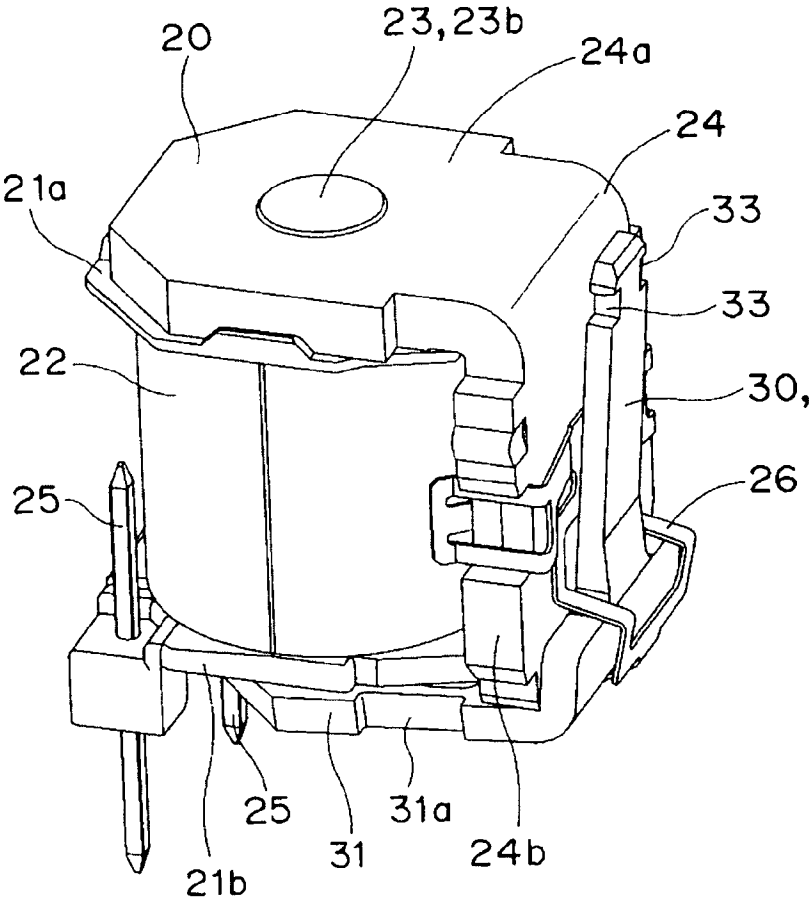

Embodiments according to the present invention will be described with reference to FIGS. 1 to 9.

In an electromagnetic relay according to a first embodiment, as shown in FIGS. 1 to 5B, an electromagnet portion 20, a moving iron 30, a contact mechanism portion 40, and a card 50 are housed in a housing 10 formed by fitting a case cover 13 with a base 11.

The base 11 is formed by providing an insulating wall 12 having a substantially II planar shape and protruding from a substantially central portion of an upper face of the base 11. The electromagnet portion 20 which will be described later is disposed while surrounded with the insulating wall 12 on a half of the upper face of the base 11 and the contact mechanism portion 40 which will be described later is disposed on the other half of the upper face. From a lower face of the base 11, a plurality of leg portions 14 protrude. This is advantageous in that collision noise is less likely to be directly propagated from the base 11 to a substrate or the like (not shown) and that a high silencing effect can be obtained.

The electromagnet portion 20 is formed by winding a coil 22 around a spool 21 having flange portions 21*a*, 21*b* at opposite end portions and inserting an iron core 23 having a T-shaped section through a central hole of the spool 21 to use protruding one end portion of the iron core 23 as a magnetic pole portion 23*a* and to swage protruding the other end portion 23*b* onto a horizontal portion 24*a* of a yoke 24 having a substantially L-shaped section. A pair of coil terminals 25, 25 are press fitted into a lower flange portion 21*b* of the spool 21 and lead wires of the coil 22 are entwined around and soldered to the coil terminals 25, 25, respectively.

Figure 5B:
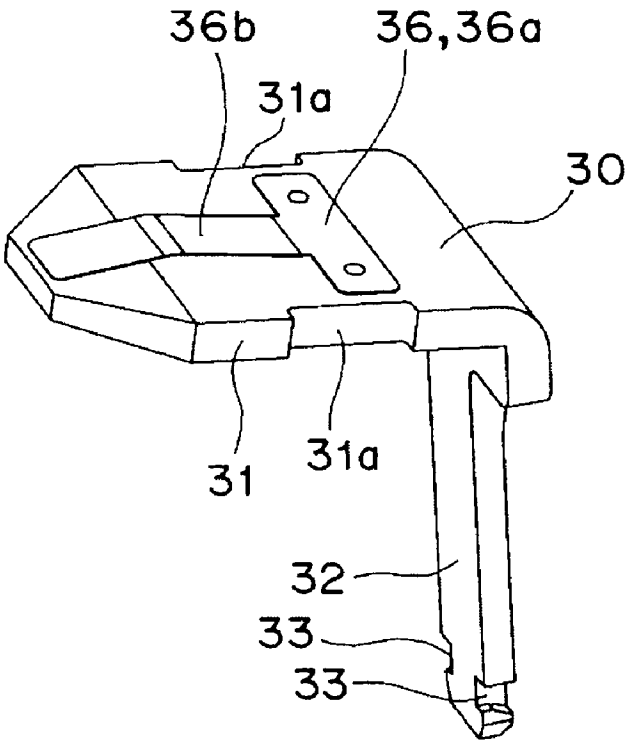
FIGS. 5A and 5B show perspective views of a moving iron shown in FIGS. 4A and 4B.
Figure 5A:
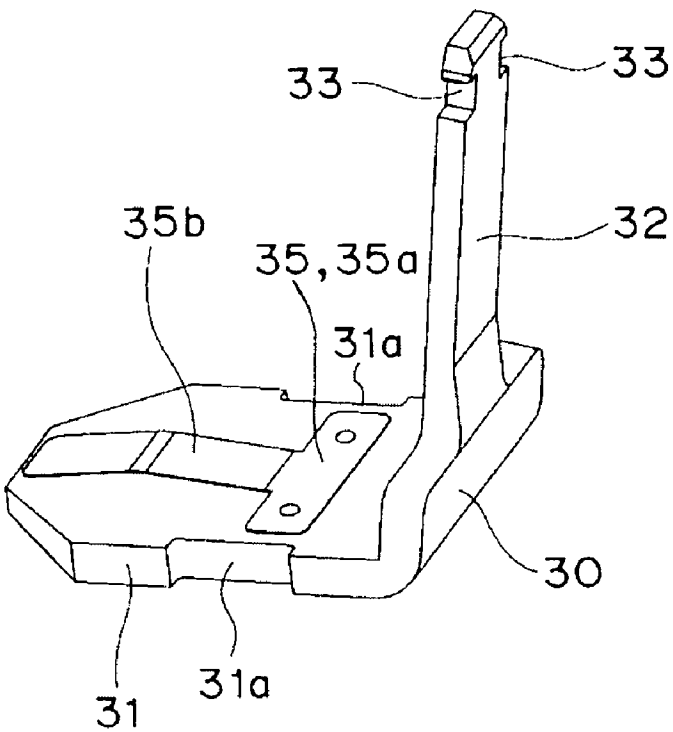
Figure 6A:
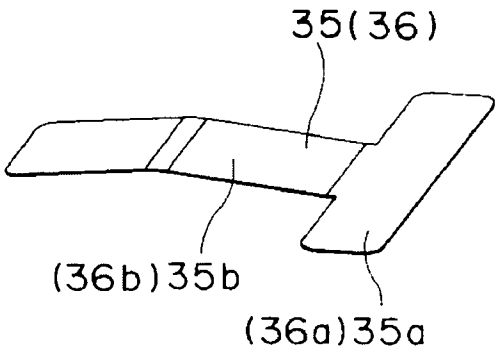
FIGS. 6A and 6B show perspective views of a silent spring shown in FIGS. 5A and 5B.
Figure 6B:
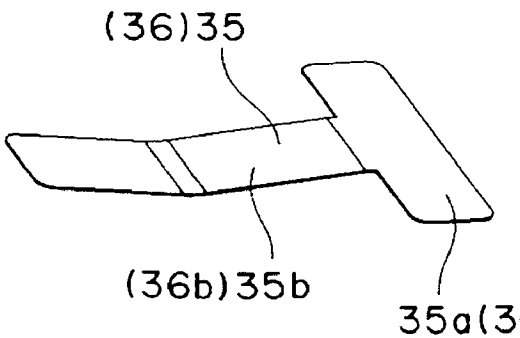

The moving iron 30 is made of a magnetic member bent to have a substantially L-shaped section as shown in FIG. 5 and formed at opposite side edge portions of a wide horizontal portion 31 with positioning notch portions 31*a*, 31*b*. The moving iron 30 is formed at an upper end portion of a narrow vertical portion 32 with engaging notch portions 33 to be engaged with a card 50 which will be described later. Furthermore, first and second silent springs 35, 36 having the same shapes are respectively secured to and integrated with upper and lower faces of the horizontal portion 31 by electric welding. The first and second silent springs 35, 36 have substantially T planar shapes in which narrow elastic portions 35*b*, 36*b* extend from the centers of wide mounting portions 35*a*, 36*a*, respectively, as shown in FIGS. 6A and 6B. It is needless to say that the first and second silent springs 35, 36 do not necessarily have to be fixed by electric welding but may be fixed by swaging.

According to the embodiment, because silent springs 35, 36 can be simultaneously integrated with the upper and lower faces of the horizontal portion 31 of the moving iron 30 by electric welding, there is an advantage that man-hours required for assembly can be reduced to thereby reduce production cost.

The moving iron 30 is positioned at a lower end edge portion of a vertical portion 24*b* of the yoke 24 and supported for turning through a hinge spring 26. As a result, the horizontal portion 31 of the moving iron 30 faces the magnetic pole portion 23*a* of the iron core 23 to be able to come in contact with the magnetic pole portion 23*a*. In a non-excited state, the silent spring 35 is not in contact with the magnetic pole portion 23*a* of the iron core 23. By mounting the electromagnet portion 20 from above along the insulating wall 12 of the base 11, the electromagnet portion 20 is fixed to the base 11.

The contact mechanism portion 40 is formed of a fixed contact piece 43 provided with a fixed contact 44 and a moving contact piece 41 provided with a moving contact 42. The fixed contact piece 43 and the moving contact piece 41 are respectively press fitted in the base 11 to stand to thereby oppose the moving contact 42 to the fixed contact 44 so that the moving contact 42 can come in contact with and move away from the fixed contact 44.

The card 50 is a resin molded product for coupling the electromagnet portion 20 and the contact mechanism portion 40 by engaging one end of it to the notch portions 33 of the moving iron 30 and engaging the other end portion of it to an upper end portion of the moving contact piece 41 of the contact mechanism portion 40.

Consequently, by fitting the case cover 13 with the base 11 after mounting the electromagnet portion 20 mounted with the moving iron 30 and mounting the contact mechanism portion 40 to the base 11, respectively, and coupling them with the card 50, the electromagnet portion 20 and the like are housed in the housing 10.

Next, operation of the electromagnetic relay formed of the above-described component parts will be described.

When the electromagnet portion 20 is not excited, the moving iron 30 is biased by spring force of the moving contact piece 41 through the card 50 and the moving contact 42 is separated from the fixed contact 44. On the other hand, the horizontal portion 31 of the moving iron 30 is separated from the magnetic pole portion 23*a* of the iron core 23 and the second silent spring 36 is in pressure contact with a bottom face of the base 11.

Then, if a voltage is applied to excite the coil 22, the horizontal portion 31 of the moving iron 30 is attracted to the magnetic pole portion 23*a* of the iron core 23 and turns. As a result, the vertical portion 32 of the moving iron 30 presses the moving contact piece 41 through the card 50 and therefore the moving contact piece 41 turns and the moving contact 42 comes in contact with the fixed contact 44. Furthermore, the first silent spring 35 comes in contact with the magnetic pole portion 23*a* of the iron core 23 and then the horizontal portion 31 of the moving iron 30 is attracted to the magnetic pole portion 23*a* of the iron core 23 through the first silent spring 35.

Then, if application of the voltage to the coil 22 is stopped, the moving iron 30 is pushed back by the spring force of the moving contact piece 41 through the card 50. As a result, the moving iron 30 turns in an opposite direction, the first silent spring 35 and the horizontal portion 31 of the moving iron 30 move away from the magnetic pole portion 23*a* of the iron core 23, and the moving contact 42 moves away from the fixed contact 44. Then, the second silent spring 36 provided to the horizontal portion 31 of the moving iron 30 comes in contact with the bottom face of the base 11.

According to the embodiment, even if the first silent spring 35 comes in contact with the magnetic pole portion 23*a* of the iron core 23 as the moving iron 30 turns or even if the second silent spring 36 comes in contact with the bottom face of the base 11, the first and second silent springs 35, 36 absorb and reduce the collision noise to thereby provide a quiet electromagnetic relay. Especially, because the second silent spring 36 comes in contact with the base 11 that is the resin molded product, an extremely quiet electromagnetic relay can be obtained.

Figure 6C:
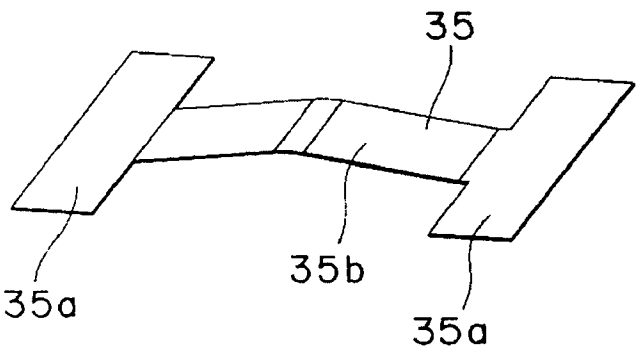
FIGS. 6C and 6D show perspective views of a silent spring according to a second embodiment.
Figure 6D:
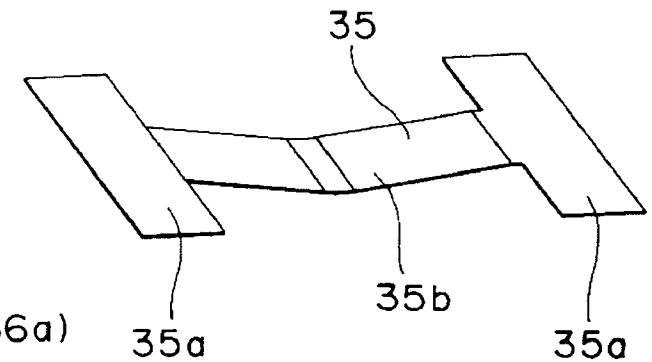
Figure 6E:
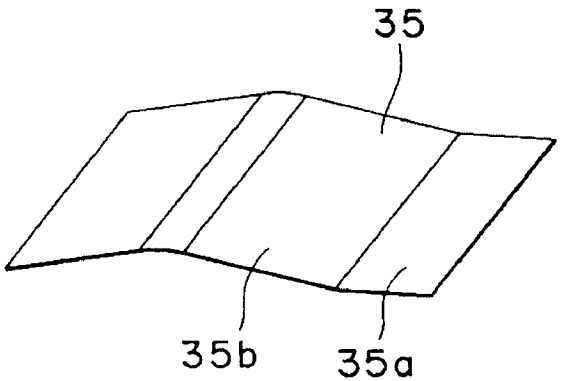
FIGS. 6E and 6F show perspective views of a silent spring according to a third embodiment.
Figure 6F:
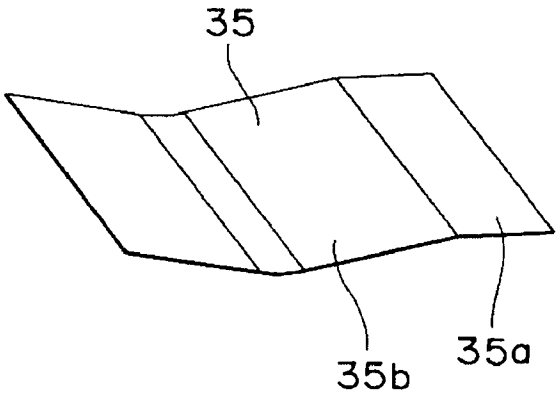

Although the silent spring having the substantially T planar shape has been described in the above embodiment, the spring is not necessarily limited to it. For example, the spring may be a silent spring 35 (the second embodiment) having a substantially H planar shape in which an elastic portion 35*b* having a tapered face is provided between mounting portions 35*a*, 35*a* of a pair as shown in FIGS. 6C and 6D, for example. The present embodiment is advantageous in that a mounted orientation is not specified and that positioning is easy. Moreover, the spring may be a silent spring 35 (a third embodiment) in which a wide elastic portion 35*b* having a tapered face is provided to a wide mounting portion 35*a* as shown in FIGS. 6E and 6F.

Figure 7A:
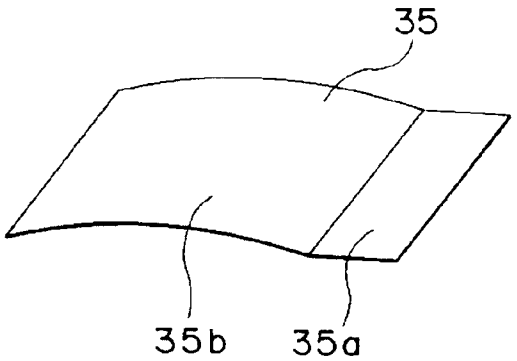
FIGS. 7A and 7B show perspective views showing a silent spring according to a fourth embodiment.
Figure 7B:
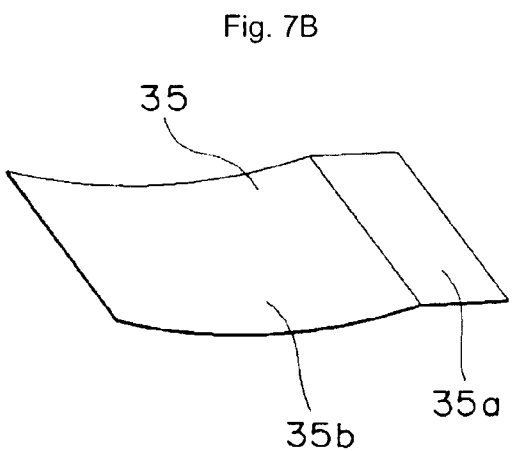
Figure 7C:
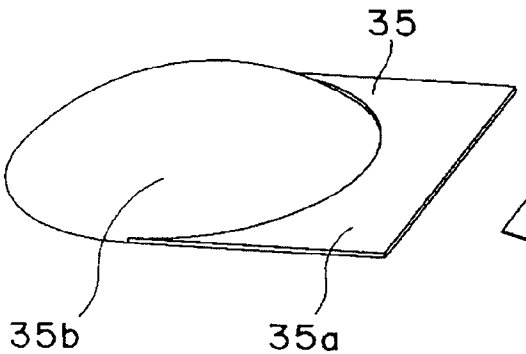
FIGS. 7C and 7D show perspective views showing a silent spring according to a fifth embodiment.
Figure 7D:
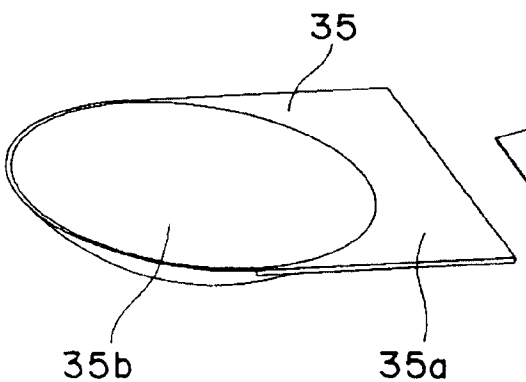
Figure 7E:
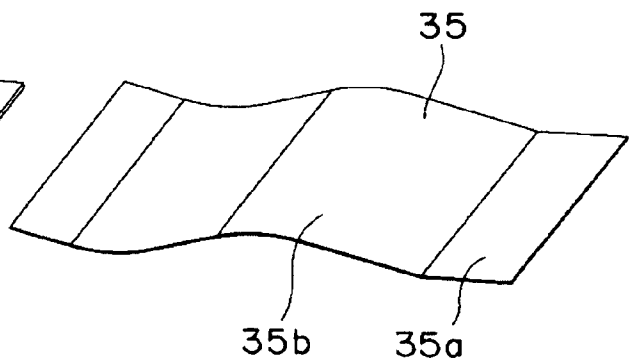
FIGS. 7E and 7F show perspective views showing a silent spring according to a sixth embodiment.
Figure 7F:
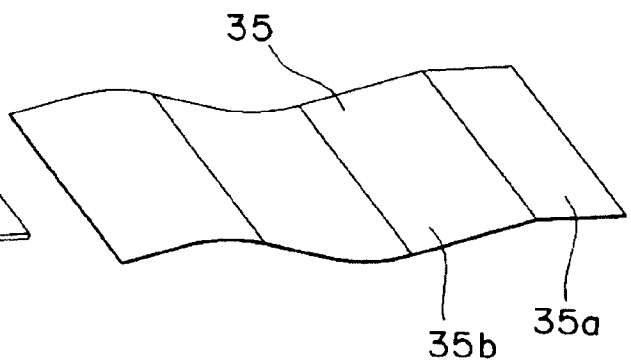

Furthermore, the spring may be a silent spring 35 (a fourth embodiment) in which a wide elastic portion 35*b* having a curved face extends from a wide mounting portion 35*a* as shown in FIGS. 7A and 7B, a silent spring 35 (a fifth embodiment) in which a dome-shaped elastic portion 35*b* extends from a wide mounting portion 35*a* as shown in FIGS. 7C and 7D, and a silent spring 35 (a sixth embodiment) in which a wide elastic portion 35*b* having a curved face extends from a wide mounting portion 35*a* as shown in FIGS. 7E and 7F.

Figure 8A:
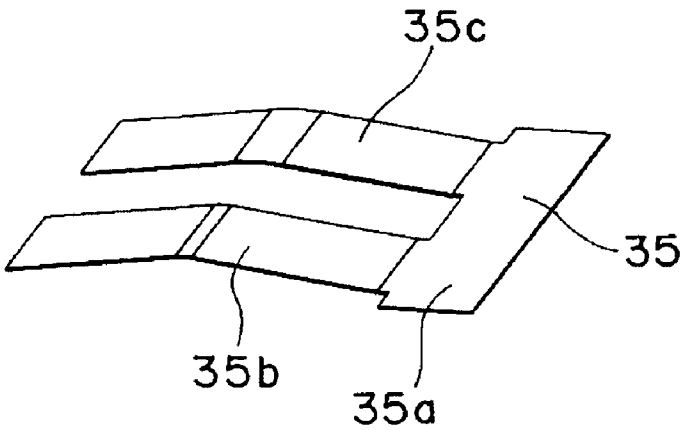
FIGS. 8A and 8B show perspective views of a silent spring according to a seventh embodiment.
Figure 8B:
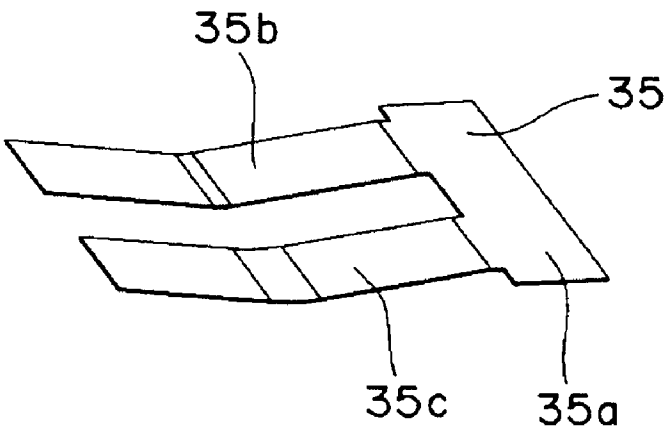

Moreover, the spring may be a silent spring 35 (a seventh embodiment) having a substantially II planar shape in which two elastic portions 35*b*, 35*c* having tapered faces extend parallel from a wide mounting portion 35*a* as shown in FIGS. 8A and 8B. Especially, the elastic portions 35*b*, 35*c* of the silent spring 35 according to the seventh embodiment have different bending angles and different mountain heights. Therefore, after first bringing the higher-mountain elastic portion 35*b* in contact to thereby reduce speed and acceleration of the moving iron 30, the lower-mountain elastic portion 35*c* may be brought in contact to bring a spring load in contact. According to the present embodiment, there is an advantage that the most suitable adjustment to an operation stroke of the moving iron 30 becomes possible to thereby obtain a high silencing effect.

Figure 9:
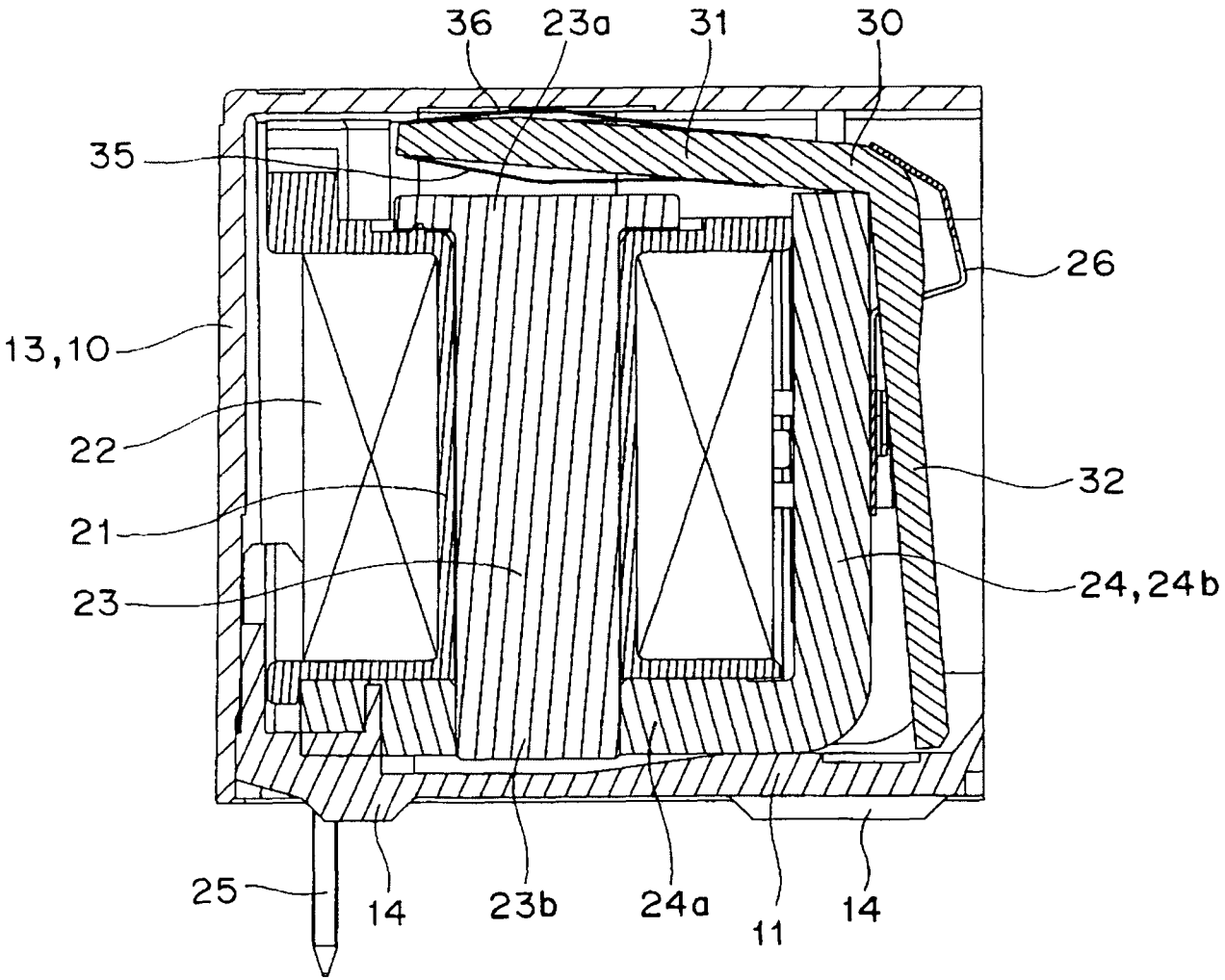
FIG. 9 shows a partial sectional view of a silent electromagnetic relay and showing an eighth embodiment.

An eighth embodiment is a case where a second silent spring 36 fixed to a moving iron 30 is brought in contact with a ceiling face of a case cover 13 fitted with a base 11 as shown in FIG. 9. Because other portions are similar to those in the above-described embodiments, the same portions are provided with the same reference numerals to omit description of them.

EXAMPLE

In the electromagnetic relay according to the first embodiment, amounts of change in an operation sound and a return sound before and after mounting of the first and second silent springs were measured. The result showed a reduction of the operation sound by about 10 dB and a reduction of the return sound by about 20 dB due to mounting of the first and second silent springs.

INDUSTRIAL APPLICABILITY

It is needless to say that the silent electromagnetic relay according to the invention is not limited to the above-described embodiments but may be applied to other electromagnetic relays.

What is claimed is:

1. A silent electromagnetic relay comprising:

an L-shaped moving iron for-turning based on excitation and demagnetization of an electromagnet portion housed in a housing that is a resin molded product;

a first silent spring mounted in a position of an inward face of the moving iron to be attracted to an iron core of the electromagnet portion; and a second silent spring for coming in contact with an inner face of the housing is mounted to an outward face of the moving iron and on an opposite side to the first silent spring;

wherein the first silent spring and the second silent spring have the same shapes.

2. A silent electromagnetic relay according to claim 1, wherein the second silent spring comes in contact with a bottom face of the housing.

3. A silent electromagnetic relay according to claim 1, wherein the second silent spring comes in contact with a ceiling face of the housing.

* * * * *